US006882119B2

(12) United States Patent
Shields

(10) Patent No.: US 6,882,119 B2
(45) Date of Patent: Apr. 19, 2005

(54) LAMP WITH MULTIPLE LIGHT-PRODUCING ELEMENTS

(76) Inventor: Alan Shields, 2117, Maurice blvd., Lafontaine, Quebec (CA), J7Y 4M8

( * ) Notice: Subject to any disclaimer, the term of this patent is extended or adjusted under 35 U.S.C. 154(b) by 0 days.

(21) Appl. No.: 10/695,954

(22) Filed: Oct. 30, 2003

(65) Prior Publication Data

US 2004/0090190 A1 May 13, 2004

Related U.S. Application Data

(63) Continuation of application No. PCT/CA01/00652, filed on May 3, 2001.

(51) Int. Cl.[7] ..... G05F 1/00

(52) U.S. Cl. ..... 315/291; 315/307; 307/41

(58) Field of Search ..... 315/219, 224, 315/291, 307, 209 R, 308; 307/41, 115

(56) References Cited

U.S. PATENT DOCUMENTS

| | | | | |
|---|---|---|---|---|
| 780,613 A | | 1/1905 | Meyers | 313/112 |
| 1,239,275 A | | 9/1917 | Keen | 200/6 AB |
| 1,895,820 A | | 1/1933 | Reeves | 123/179.3 |
| 2,360,128 A | | 10/1944 | Hausler | 741/100.2 |
| 2,901,568 A | | 8/1959 | Goff | 200/409 |
| 3,117,197 A | | 1/1964 | Etal | 200/437 |
| 3,234,342 A | | 2/1966 | Murray | 200/51 R |
| 3,413,430 A | | 11/1968 | Sharples | 200/1 B |
| 3,491,231 A | | 1/1970 | Larkin | 362/212 |
| 3,697,802 A | | 10/1972 | Demas | 315/65 |
| 3,968,395 A | | 7/1976 | Obermaier | 315/65 |
| 4,447,765 A | | 5/1984 | Cote | 315/240 |
| 4,654,560 A | | 3/1987 | Cote | 315/49 |
| 4,665,341 A | | 5/1987 | Imamura et al. | 313/493 |
| 5,345,143 A | | 9/1994 | Little | 315/64 |
| 5,477,111 A | * | 12/1995 | Steely et al. | 315/194 |
| 5,932,973 A | | 8/1999 | Cecchetti | 315/64 |
| 6,137,240 A | * | 10/2000 | Bogdan | 315/307 |
| 6,700,333 B1 | * | 3/2004 | Hirshi et al. | 315/291 |

FOREIGN PATENT DOCUMENTS

| | | |
|---|---|---|
| CH | 650888 A | 8/1985 |
| FR | 2616589 A | 12/1988 |
| GB | 2121247 A | 12/1983 |
| JP | 05258729 | 10/1993 |

* cited by examiner

*Primary Examiner*—Tuyet Vo
*Assistant Examiner*—Jimmy Vu
(74) *Attorney, Agent, or Firm*—E. Martineau

(57) ABSTRACT

The lamp circuit includes a power supply, a main switch, and a light and control circuit all serially connected, the light and control circuit wherein the following elements connected in parallel: a first light-producing element capable of producing light of a first type and serially connected to a first switch member; a second light-producing element capable of producing light of a second type and serially connected to a second switch member; and a control circuit member selectively commanding either one of the first switch member, the second switch member and both the first and second switch members to be closed upon the main switch closing the lamp circuit, the first and second switch members remaining opened if not commanded otherwise by the control circuit member.

18 Claims, 8 Drawing Sheets

LAMP WITH MULTIPLE LIGHT-PRODUCING ELEMENTS

CROSS-REFERENCE DATA

The present invention is a continuation of International Application PCT/CA01/00652 filed May 3, 2001.

FIELD OF THE INVENTION

The present invention relates to lamps, and more particularly to a lamp having multiple light-producing elements.

BACKGROUND OF THE INVENTION

Different types of lamps exist, which include respective types of light-producing elements. Examples of such light-producing elements include incandescent light bulbs, fluorescent neon light tubes and halogen-tungsten bulbs.

Incandescent light bulbs are widely used and well known. Most of these incandescent light bulbs have a screw base allowing the light bulbs to be screwed into a complementary threaded socket, be it located on a room wall or ceiling, at the end of the elongated rod of a stand-lamp, or any other known position for light bulb sockets. Halogen-tungsten lamps have light bulbs which can similarly engage a complementary socket. Neon light tubes are operatively mounted to a socket called a ballast.

The known light-producing elements have a certain life span during which they can produce light, after which they must be dispatched and replaced with a new light-producing element. Therefore, the light-producing elements are removable from their respective sockets for allowing this replacement with a new light-producing element when they become burned out or otherwise unusable.

A problem associated with conventional lamps having a single light-producing element is that they must be unscrewed and removed if a light of another color than the one being emitted from the light bulb is desired.

SUMMARY OF THE INVENTION

The present invention relates to a lamp circuit including a power supply, a main switch, and a light and control circuit all serially connected, said light and control circuit comprising the following elements connected in parallel:

a) a first light-producing element capable of producing light of a first type and serially connected to a first switch member;

b) a second light-producing element capable of producing light of a second type and serially connected to a second switch member; and c) a control circuit member selectively commanding a selected one of said first switch member, said second switch member and both said first and second switch members to be closed upon said main switch closing said lamp circuit, said first and second switch members remaining opened if not commanded otherwise by said control circuit member.

Preferably, said control circuit member will selectively close a single one among said first and second switch members upon said main switch closing said lamp circuit, whereby said first light-producing element only will be fed with electrical current if said first switch member is closed, while said second light-producing element only will be fed with electrical current if said second switch member is closed, said lamp consequently emitting light of either one of said first and second types.

Preferably, said control circuit member includes a microchip capable of commanding a selected one of said first and second switch members to be closed upon said main switch closing said lamp circuit, and wherein said microchip will command said second switch member only to be closed thereby feeding said second light-producing member only with electrical current upon said main switch, from an initial closed condition, being opened and closed again within a time interval equal or inferior to a determined threshold amount of time, said microchip otherwise commanding said first switch member only to be closed thereby feeding said second light-producing member only with electrical current upon said main switch, from an initial opened condition, being closed.

Preferably, said threshold amount of time is controlled by means of a first capacitor provided in said control circuit member, which will feed said control circuit member, including said microchip, with a minimum working voltage value during a time interval equal to said threshold amount of time when said main switch opens said lamp circuit.

Preferably, said microchip includes a clock which will be fed with an electric pulse by a field effect transistor or a micro-battery upon said main switch, from an initial closed condition, being opened and closed again within a time interval equal or inferior to said threshold amount of time, said second loaded capacitor remaining fed with electrical current during a time interval equal to said threshold amount of time by means of said first capacitor, said electric pulse activating said microchip clock for changing the output value of said microchip from a first output value associated with and commanding said first switch member to a second output value associated with and commanding said second switch member.

Preferably, said first and second switch members are both TRIAC-type static switches.

Preferably, said lamp circuit further includes at least one additional light-producing element connected in parallel to said first light-producing element, said second light-producing element and said control circuit member, each said at least one additional light-producing element capable of producing light of a distinct type and serially connected to a corresponding switch member, said control circuit member selectively closing any single one among said first, second and at least one additional switch members upon said main switch closing said lamp circuit.

Preferably, said lamp circuit further includes at least one additional light-producing element connected in parallel to said first light-producing element, said second light producing element and said control circuit member, each said additional light-producing element capable of producing light of a distinct type and serially connected to a corresponding additional switch member, said control circuit member selectively closing any single one among said first, second and additional switch members upon said main switch closing said lamp circuit, said microchip commanding said at least one additional switch member to be closed and all other switch members to be opened thereby feeding said corresponding additional light-producing member only with electrical current upon said main switch, from an initial closed condition in which a preceding switch member corresponding to a light-producing member was activated, being opened and closed again within a time interval equal or inferior to said threshold amount of time.

The present invention also relates to a lamp capable of emitting two different types of light, said lamp comprising:

a power supply;

a first light-producing element connected to said power supply and capable of producing light of a first type;

a second light-producing element connected to said power supply and capable of producing light of a second type;

a control circuit member connected to said power supply, to said first light-producing element and to said second light-producing element; and a main switch connected to said power supply, said control circuit member, said first light-producing element and said second light-producing element, said main switch allowing selective on/off feeding of electrical current from said power supply to a circuit assembly comprising said control circuit member, said first light-producing element and said second light-producing element;

wherein said control circuit member will selectively allow current to be fed to a selected one of said first light-producing element, said second light-producing element and the combination of said first light-producing element and said second light-producing element when said main switch allows current to be fed to said circuit assembly.

Preferably, said first and second light-producing elements each comprises a pane enclosing an incandescent filament, with each said pane being a selected from transparent and translucent panes.

Preferably, said pane of said first light-producing element is located within said pane of said second light-producing element, and said filament of said second light-producing element is located between said pane of said first light-producing element and said pane of said second light-producing element.

Preferably, said pane of said first light-producing element is tainted of a selected color, and said pane of said second light-producing element is transparent.

Preferably, said lamp further comprises at least one additional light-producing element part of said circuit assembly and connected to said power supply, said control circuit member and said switch, said at least one additional light-producing element each capable of producing a light of an additional distinct type, wherein said control circuit member will selectively allow current to be fed to a selected one of said first light-producing element, said second light-producing element, said at least one additional light-producing element and a combination including a number of said light-producing elements when said switch allows current to be fed to said circuit assembly.

Preferably, said first and second light-producing elements each comprises a tubular pane sealingly enclosing a pair of electrodes and an inert gas, with each said pane being selected from transparent and translucent panes.

Preferably, said pane of said first light-producing element is located within said pane of said second light-producing element, and said pair of electrodes of said second light-producing element is located between said pane of said first light-producing element and said pane of said second light-producing element.

Preferably, said pane of said first light-producing element is tainted of a selected color, and said pane of said second light-producing element is transparent.

The present invention also relates to a light bulb for use within a conventional lamp circuit of the type including a socket on which said light bulb may be electrically connected, a power supply connected to said socket, and a main switch allowing selective on/off feeding of electrical current to said socket, said light bulb comprising:

a base member shaped and sized for fitting said light bulb on said socket and for allowing operative electrical connection with said socket;

a first and at least one second light-producing elements operatively mounted to and electrically connected with said base;

a control circuit member mounted and electrically connected to said base and comprising a first and at least one second switch members each controlling a corresponding respective said first and at least one second light-producing elements; wherein said control circuit member will command a selected single one among said second switch members to be closed and all other switch members to be opened thereby feeding only said second light-producing member corresponding to said selected one among said second switch members with electrical current upon said main switch, from an initial closed condition in which a preceding switch member corresponding to a light-producing member was activated, being opened and closed again within a time interval equal or inferior to a determined threshold amount of time, said control circuit member otherwise commanding said first switch member to be closed and all other said switch members to be opened thereby feeding only said first light-producing member corresponding to said first switch member with electrical current upon said main switch being closed.

DETAILED DESCRIPTION OF THE EMBODIMENTS

Figure 1:
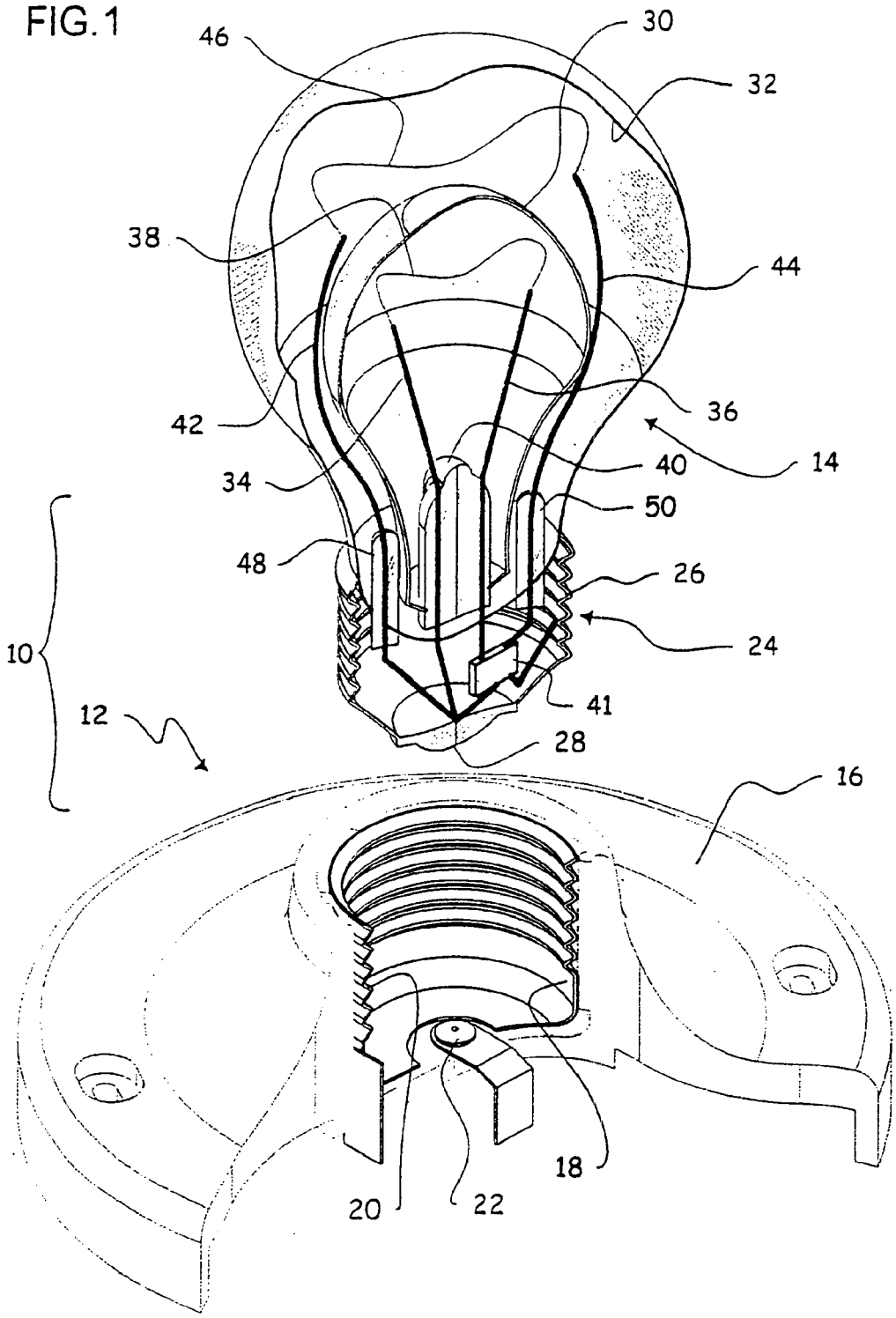
FIG. 1 is a perspective view, partly broken, of an incandescent lamp with two colors according to the present invention.

FIG. 1 shows a lamp 10 with two colors according to the present invention. Lamp 10 comprises a socket 12 and an incandescent light bulb 14.

Socket 12 is of the conventional type, including a rigid frame 16 which could be fixed for example to a ceiling, and a central bore 18. Bore 18 includes a peripheral electrically-conducting threaded sleeve 20, and a bottom electrically-conducting spring blade connector 22 which is electrically insulated relative to sleeve 20. As known in the art, connector 22 and sleeve 20 are each connected to one of the positive and negative outputs of an electrical power supply (not shown in FIG. 1).

Light bulb 14 comprises a screw base 24 having a threaded electrically-conducting cylindrical wall portion 26 and an electrically-conducting lower connector stud 28 which are electrically insulated relative to each other and which will respectively engage sleeve 20 and connector 22 of socket 12 when light bulb 14 threadingly engages socket 12 in a manner well known in the art.

Inner and outer concentric transparent or translucent globes 30, 32 are fixedly mounted to screw base 24. Globes 30, 32 can be made for example of plastic, glass or crystal.

Inside inner globe 30 are provided a pair of inner lead-in wires 34, 36 which support a transversely extending inner filament 38. Lead-in wires are in turn supported by an insulating glass bracket 40 which is carried by screw base 24, as known in the art. One lead-in wire 34 is electrically connected to the electrically-conducting lower connector stud 28 of screw base 24, while the other lead-in wire 36 is electrically connected to a control circuit member 41 carried by screw base 24.

In the area between inner and outer globes 30 and 32 are located a pair of outer lead-in wires 42, 44 which support a transversely-extending outer filament 46. Lead-in wires 42, 44 are in turn supported by respective insulating glass brackets 48, 50 which are carried by screw base 24, as known in the art. One lead-in wire 42 is electrically connected to the electrically-conducting lower connector stud 28 of screw base 24, while the other lead-in wire 44 is electrically connected to control circuit member 41.

Control circuit member 41 is connected to electrically-conducting stud 28 and electrically conducting wall 26 of screw base 24. Its purpose is to allow the electrical current to selectively engage either the inner filament 38 or the outer filament 46, in a manner detailed hereinafter. It is possible to provide inner and outer globes 30, 32 of different colors or of different levels of transparency, to thus obtain a different lighting effect depending on whether the inner filament 38 or the outer filament 46 radiates light. For example, if the inner globe has a greenish taint, and the outer globe is transparent, then upon the inner filament 38 being fed with electrical current, the light emitted by light bulb 14 will be greenish due to the inner globe's green-tainted translucency. However, upon the outer filament 46 being fed with electrical current, the light emitted by light bulb 14 will be white due to the outer globe's transparency—the inner globe 30 not influencing the light emitted by light bulb 14 exteriorly of inner globe 30.

According to the present invention, it is possible with control circuit member 41 to select which filament 38 or 46 will be fed with electrical current, through a single, conventional on/off switch, in a manner described hereinafter. Thus, the light bulb 14 of the invention could be installed on a conventional socket 12 controlled by a conventional on/off switch, while still allowing selection of the color of the light emitted by light bulb 14 through the selection of which filament 38 or 46 would be fed with electrical current. This selective choice of the filament 38 or 46 to be fed with electrical current, is accomplished by varying the interval of time between which the light switch, from an initial position in which it closes the electrical circuit of the lamp to allow electrical current to be flow in the lamp circuit and feed a first one of the filaments, opens the electrical circuit and then closes it again. If this time interval remains under a certain determined threshold amount of time, then the second filament will be fed with electrical current instead of the first one. However, should the above-mentioned time interval between the light switch opening and closing the circuit again be greater than the above-mentioned determined threshold amount of time, then the first filament will be fed with electrical current again upon the main switch closing the lamp circuit.

Let us take the following example. The threshold amount of time is equal to five seconds. When the light switch closes the electrical circuit for the first time, the outer filament 46 will be fed with electrical current, and the light emitted outside of light bulb 14 will be white due to the transparent outer globe 32 not filtering the light. Upon the light switch opening the lamp circuit, none of the filaments radiates light. Then:

a) if a time interval equal or inferior to five seconds elapses before the light switch closes the lamp circuit again, then the electrical current will be fed through inner filament 38 instead of outer filament 46, and thus the light emitted by light bulb 14 will be partly filtered by the translucent, greenish inner globe 30; or b) if more than five seconds elapse before the light switch closes the lamp circuit again, then the electrical current will be fed again through outer filament 46 and the light emitted by light bulb 14 will be white again.

This ends the example.

Figure 2:
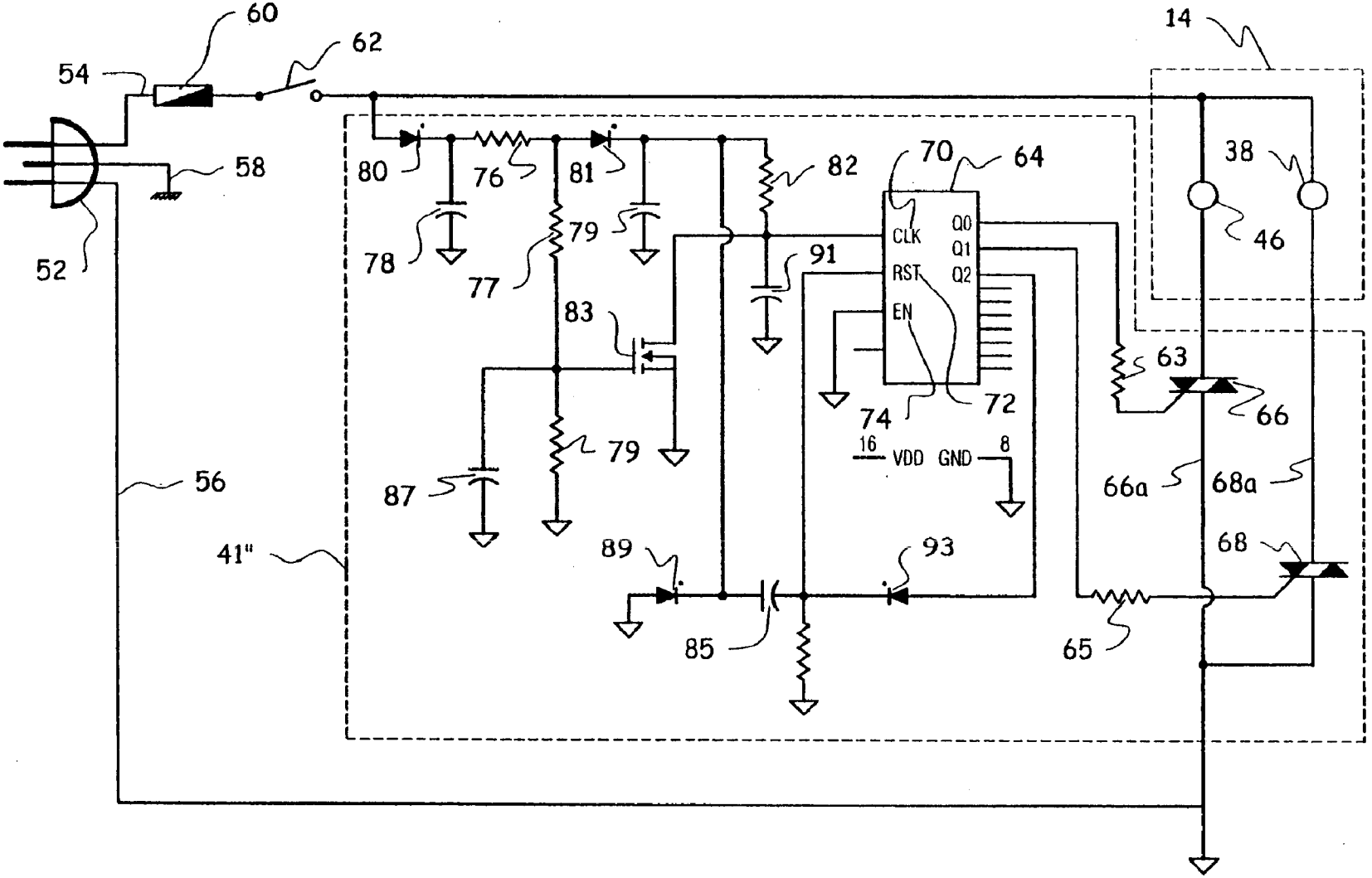
FIG. 2 is a diagram of the electrical circuit of the lamp of FIG. 1.

Control circuit member 41 is responsible for selectively directing the electrical current either through inner or outer filaments 38, 46. FIG. 2 is a diagram of the circuit of lamp 10, including control circuit member 41. Control circuit member 41 is one way to carry out the invention.

FIG. 2 shows that the lamp power supply outlet 52 stems into a positive and a negative branch 54, 56, in addition to the ground 58. A fuse 60 and a switch 62 are serially located between power supply outlet 52 and the remaining portion of the positive branch 54 of the circuit of lamp 10. Branch 54 is then directly linked to three elements connected in parallel:

(a) inner filament 38, (b) outer filament 46, and (c) control circuit member 41. Inner and outer filaments 38, 46 are also linked to the negative branch 56 of the circuit of lamp 10 through control circuit member 41, in a manner detailed hereinafter.

Control circuit member 41 comprises a microchip 64 which will control, through respective resistors 63 and 65, a pair of TRIAC-type static switches 66, 68 which, as known in the art, will close the circuit portions 66*a*, 68*a* connecting the outer and inner filaments 46 and 38 respectively to the negative branch 56 of the circuit of lamp 10, only when TRIAC switches 66, 68 are activated by their respective outputs Q0 and Q1 on microchip 64. Chip 64 also has an internal clock 70 and an enable function 74, the purpose of the latter being explained hereinafter. Microchip further conventionally has a reset function 72, that will be activated to set the circuit output value to Q0 when the circuit is closed after a time interval greater than the threshold amount of time.

The electrical current heading from the positive branch 54 of the circuit of lamp 10 to microchip 64 is controlled by a resistor 76 and a zener diode 89 which reduces the current feeding microchip 64, since microchip 64 requires a lower current than the lamp filaments 36, 48. Also, the current is fed through a first capacitor 78, a second capacitor 79, a fourth capacitor 91 and a load resistor 82. Two diodes 80, 81 are also provided to ensure that the current is unidirectional towards microchip 64.

The purpose of first capacitor 78, capacitor 87 and fourth capacitor 91 is to filter the electric current going through the whole electrical circuit of lamp 10. Furthermore, second capacitor 79 is calibrated to ensure that microchip 64 and third capacitor 85 continue to be fed with current during an amount of time equal to a determined threshold amount of time, while the circuit remains opened at main switch 62.

In combination, the second and third capacitors 79, 85 act as follows. If the circuit of lamp 10, from an initial closed condition, is opened during a time interval equal or inferior to the threshold amount of time, then third capacitor 85 will remain loaded due to the continuous feed of electrical current during this time from second capacitor 79, preventing the reset function from being activated. When the circuit of lamp 10 is closed again inside a time interval equal or inferior to the threshold amount of time, the loaded second capacitor 79 will maintain an electrical current to chip 64 and a field effect transistor 83 will send a negative pulse to clock 70 which will change the microchip output value from Q0 to Q1.

In use, switch 62 is initially in an opened condition, whereby no electrical current flows through the circuit of lamp 10. Both TRIAC switch 66 and TRIAC switch 68 will prevent current from passing through filaments 46 and 38 respectively, unless they are activated through their respective associated microchip outputs Q0 and Q1. When switch 62 closes the circuit of lamp 10 for the first time, microchip 64 will be initalized at output value Q0 and will send a signal to TRIAC switch 66 through its output Q0. TRIAC switch 66 will be closed to allow the current to flow through outer filament 46, while the TRIAC switch 68 will prevent the inner filament 38 from being fed with current. Thus, outer filament 46 will produce light, while inner filament 38 will not.

If switch 62 opens the circuit, no more current will feed outer filament 46. However, second capacitor 79 will continue to feed third capacitor 85 and microchip 64 for an amount of time equal to the threshold amount of time.

When switch 62 next closes the circuit, if the time interval during which the circuit was opened is greater than the threshold amount of time, then second capacitor 79 will have stopped to feed third capacitor 85 and microchip 64 will simply be re-initialized at output Q0 when switch 62 closes the circuit by the reset switch 72, outer filament 46 thus being fed with electrical current once again.

On the other hand, if the time interval during which the circuit remained opened is equal or inferior to the threshold amount of time when switch 62 closes the circuit, then second capacitor 79 will have continuously maintained the voltage in microchip 64 above a minimum working value and third capacitor 85 will have remained loaded. Upon main switch 62 closing the circuit, field effect transistor 83 will send a negative electric pulse to clock 70 of microchip 64, which will consequently change the output value from Q0 to Q1. TRIAC switch 66 will be opened and current will stop to feed outer filament 46, while output Q1 will in turn close TRIAC switch 68 to allow inner filament 38 to be fed with electrical current. Inner filament 38 will thus radiate light, while outer filament 46 will not.

If the time interval during which the circuit remains opened is equal or inferior to the threshold amount of time when switch 62 closes the circuit for a second consecutive time, the field effect transistor 83 will send a negative electrical pulse to clock 70 of microchip 64 which will consequently change the output value from Q1 to Q2. This change to output value Q2 will send a negative electrical pulse through diode 93 to reset 72 on microchip 64, changing immediately the microchip output value to Q0 to feed outer filament 46 with electrical current. The purpose of diode 93 is to ensure that no current enters microchip 64 through Q2.

Figure 3:
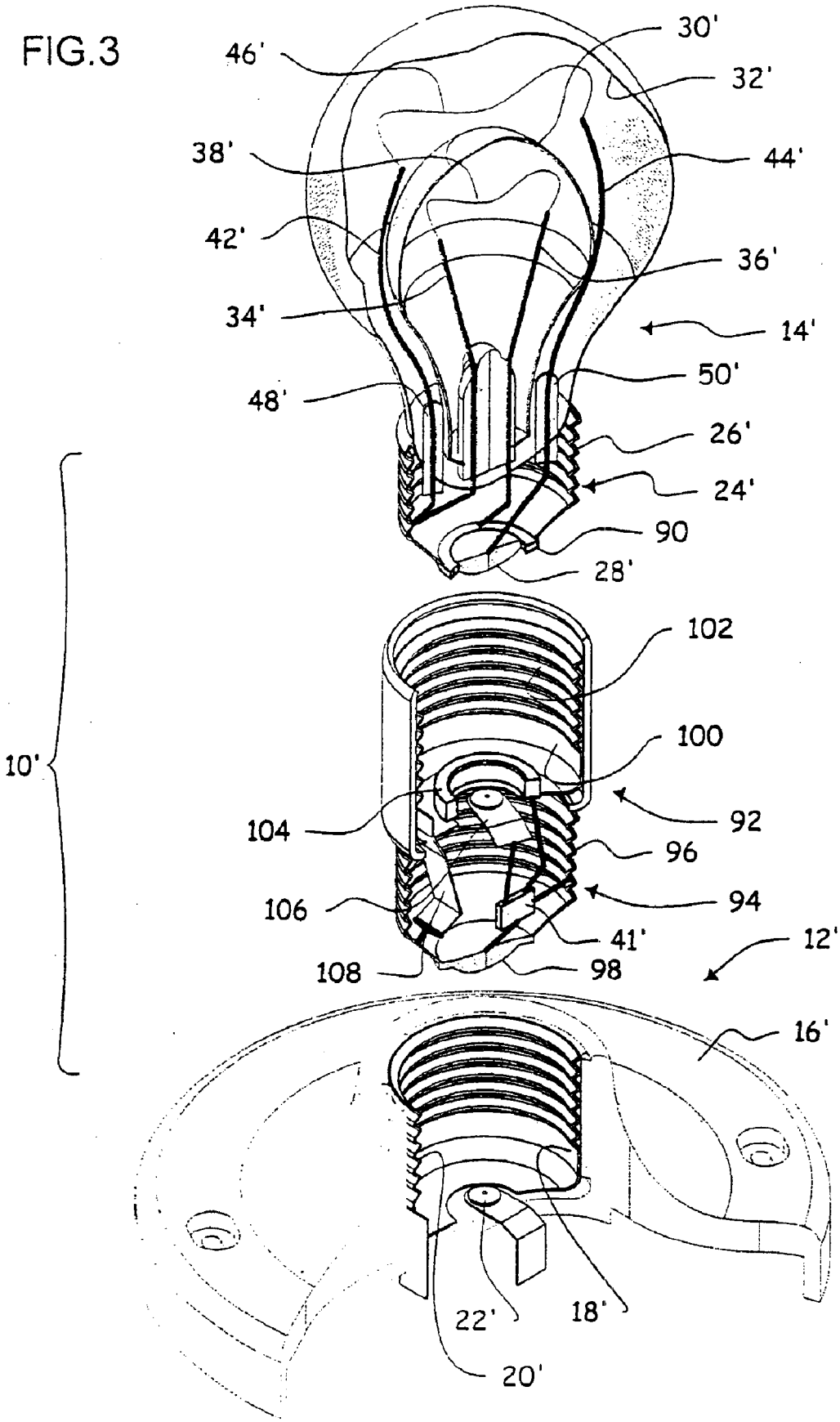
FIG. 3 is a perspective view, partly broken, of a second embodiment of an incandescent lamp with two colors according to the present invention.

FIG. 3 shows a second embodiment of a lamp 10' according to the invention, wherein primed numerals refer to similar elements of FIG. 1. FIG. 3 shows that lamp 10' comprises a conventional socket 12' of similar construction as that of FIG. 1, and a light bulb 14' which is also similar to that of FIG. 1 except for the fact that light bulb 14' does not include a control circuit member 41 to which are connected lead-in wires 36 and 44 in the embodiment of FIG. 1. Instead, in the second embodiment of FIG. 3, lead-in wire 36' is connected to a an electrically-conducting annular connector 90 which peripherally surrounds and which is electrically insulated from the electrically-lower connector stud 28' and from electrically-conducting threaded peripheral wall 26'. The lead-in wire 44' is connected to lower connector stud 28'.

The embodiment of FIG. 3 includes an intermediate connecting member 92 which is to be inserted between light bulb 14' and socket 12', with light bulb 14' threadingly engaging connecting member 92 which in turn threadingly engages socket 12'. Connecting element 92 includes a screw base 94 having a threaded electrically-conducting peripheral wall 96 and an electrically-conducting lower connector stud 98 which are electrically insulated relative to each other. Connecting element 92 further has an upper bore 100 having an inner threaded electrically-conducting sleeve 102, an electrically-conducting annular connector 104 and an electrically-conducting spring-blade connector 106 which are electrically insulated relative to one another. A control circuit member 41' similar to the control circuit member 41 of the first embodiment, is linked on one side to annular element 104 which, through its connection with annular connector 90 of light bulb 14', is connected to inner lead-in wire 36'; and to spring blade connector 106 which, through its connection with stud connector 28' of light bulb 14', is connected to outer lead-in wire 44'; and on the other side to connector stud 98' which is in turn connected to spring blade connector 22', the latter in turn connected to lead-in wires 34', 42'.

An electrically conducting plate 108 connects sleeve 102 to the screw base electrically-conducting threaded wall 96.

Figure 8:
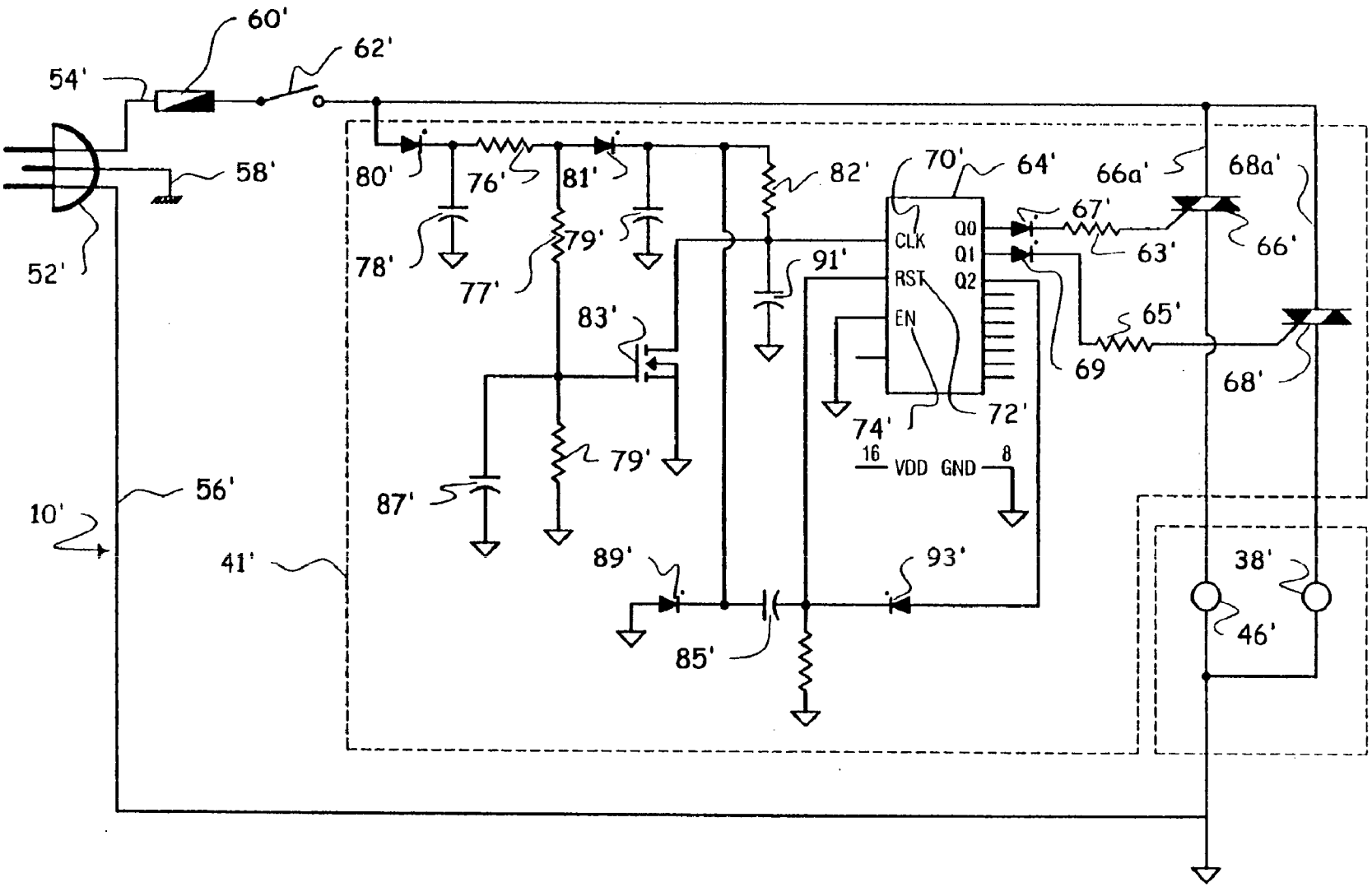
FIG. 8 is a diagram of the electrical circuit of the lamp of FIG. 3.

The lamp 10' according to the second embodiment of the invention is quite similar to the lamp 10 of the first embodiment, apart from the fact that the control circuit member 41' is located in a connecting element 92 to be inserted between light bulb 14' and socket 12'. This has the advantage, among other things, to provide light bulbs which are less expensive since they are devoid of the control circuit member, while maintaining the possibility to obtain different light colors from lamp 10' through the control of a conventional on/off light switch, as long as the light bulb is capable of producing light of different colors. The control circuit member 41' is indeed located in the intermediate connecting member 92. The circuit shown in FIG. 8 may be applied to the embodiment of FIG. 3, as will be obvious to someone skilled in the art. FIG. 8 is a diagram of the circuit of lamp 10', including control circuit member 41'. It can be seen that the diagram of FIG. 8 is similar in some respects to the diagram of FIG. 2, the only difference being the two diodes 67, 69 protecting microchip 64 from any electrical current going through outputs Q0 and Q1 to microchip 64 per se.

Figure 4:
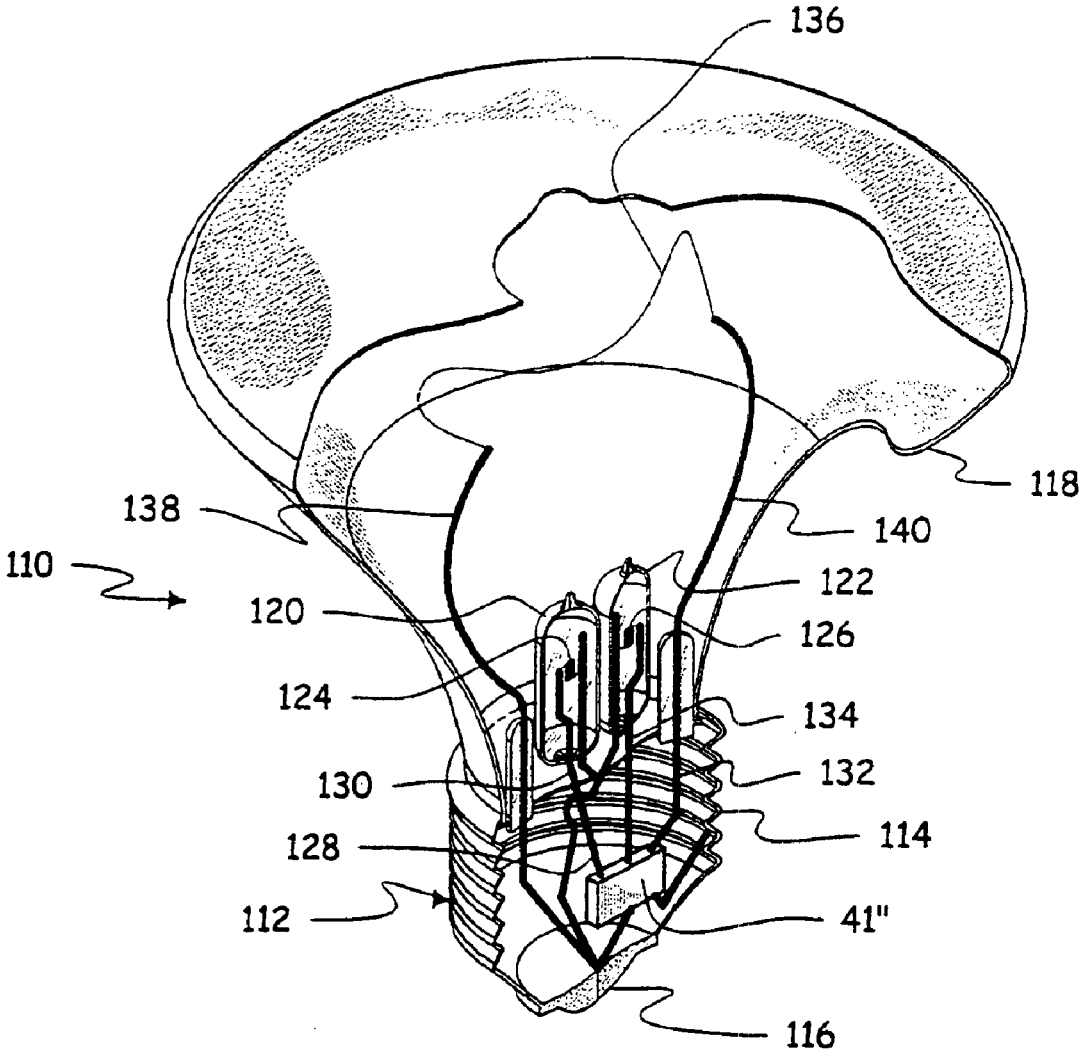
FIG. 4 is a perspective view, partly broken, of an incandescent lamp with three colors according to the present invention.

FIG. 4 shows a third embodiment of a light bulb 110 according to the present invention, which is to be installed on a conventional socket such as socket 12 shown in FIG. 1, the latter controlled by a conventional on/off switch, and fed with electrical current by a conventional power supply. Light bulb 110 comprises a screw base 112 having an electrically-conducting threaded peripheral wall 114 and an electrically-conducting lower connector stud 116 electrically insulated relative to peripheral wall 114. A single transparent or translucent outer globe 118 is mounted to screw base 112, and first and second smaller, transparent or translucent inner globes 120, 122 are also mounted to screw base 112. In one embodiment, outer globe 118 is transparent, while first and second inner globes 120, 122 are tainted with respective colors.

First and second inner filaments 124, 126 are provided inside first and second inner globes 120, 122 respectively, and are each connected to a respective pair of lead-in wires 128, 130 and 132, 134. An outer filament 136 is provided in the area between inner globes 120, 122 and outer globe 118, outer filament 136 being supported and connected to a pair of outer lead-in wires 138, 140. Lead-in wires 128, 134 and 140 are all connected to a control circuit member 41", while lead-in wires 130, 132 and 138 are connected to the electrically-conducting lower connector stud 116. Control circuit member 41" is also connected to connector stud 116 and to peripheral wall 114.

Figure 5:
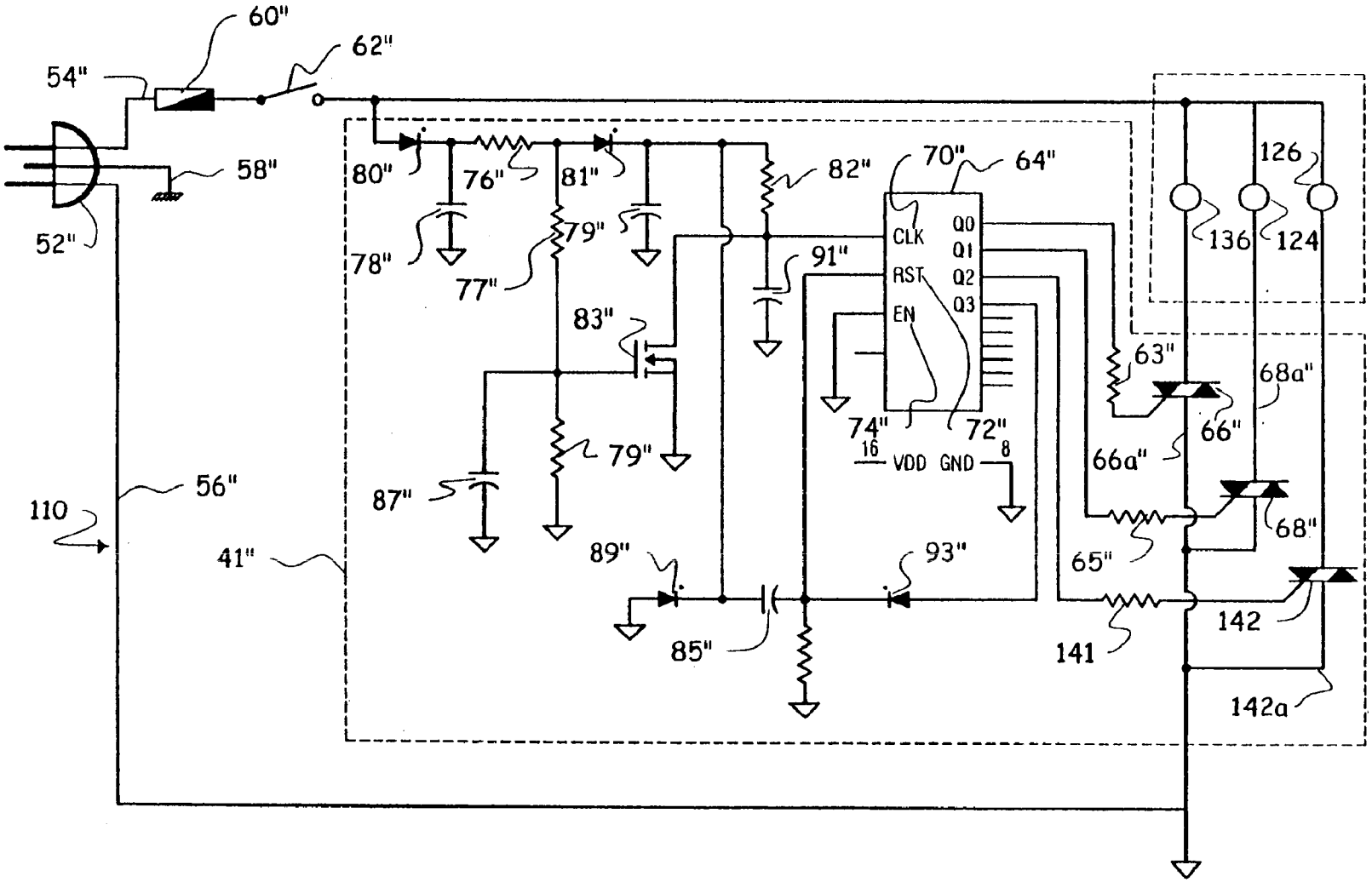
FIG. 5 is a diagram of the electrical circuit of the lamp of FIG. 4.

FIG. 5 is a diagram of the circuit of lamp 110, including control circuit member 41". It can be seen that the diagram of FIG. 5 is similar in some respects to the diagram of FIG. 2. Similar elements have been double primed in FIG. 5.

The difference between the circuit of the lamp 10 shown in FIG. 2, and the circuit of lamp 110 shown in FIG. 5, relies on the fact that there are three different filaments 136, 124, 126 which may be fed with current, each controlled by a respective TRIAC-type static switch 66", 68", 142, respectively. Microchip 64" is similar to microchip 64 of the embodiment of FIG. 2, although output Q2 is used in the present embodiment, to accommodate the additional TRIAC switch 142, and output Q3 is connected to the reset function of microchip 64.

In use, the circuit of lamp 110 will function in essentially the same way as that of lamp 10, apart from a few characteristics as detailed hereinafter. When the circuit of lamp 110 is closed for the first time with switch 62" and circuit 110 is fed with electrical current, microchip 64" will be initialized at an output value of Q0, which will activate TRIAC switch 66" to close circuit portion 66*a* and thus feed outer filament 136. If the circuit of lamp 110 is opened and closed again after a time interval greater than the threshold amount of time, then the above situation occurs again, i.e. outer filament 136 is fed with electrical current, since microchip 41" will again be initialized at output value Q0.

However, if the circuit of lamp 110 is opened and closed a first time after a time interval equal or inferior to a determined threshold amount of time, then the field effect transistor 83" will emit a pulse to the microchip clock 70" which will change the output value of microchip 64" from Q0 to Q1, consequently activating TRIAC switch 68" instead of TRIAC switch 66", first inner filament 124 being consequently fed with electrical current instead of outer filament 136. If the circuit of lamp 110 is opened and closed a second consecutive time within a time interval equal or inferior to the threshold amount of time, then the field effect transistor 83" will emit another pulse to the microchip clock 70" which will change the output value of microchip 64" from Q1 to Q2, consequently activating TRIAC switch 142 instead of TRIAC switch 68", second inner filament 126 then being fed with electrical current instead of first inner filament 124.

If the time interval during which the circuit remains opened is equal or inferior to the threshold amount of time when switch 62 closes the circuit for a third consecutive time, the field effect transistor 83" will send a negative electrical pulse to clock 70" of microchip 64" which will consequently change the output value from Q2 to Q3. This change to output value Q3 will send a negative electrical pulse through diode 93" to reset 72" on microchip 64", changing immediately the microchip output value to Q0 to feed outer filament 136 with electrical current. The purpose of diode 93" is to ensure that no current enters microchip 64" through Q3.

Thus, for example, with lamp 110, when closing the circuit for the first time, the outer filament will emit white light through a transparent globe 118. If the circuit is opened and closed again a first time within a time interval equal or inferior to the threshold amount of time, then the first inner filament 124 will be fed with current instead of the outer filament 136, thus emitting light of a first color outside of light bulb 110 due to the first coloring of first inner globe 120. If the circuit is opened and closed again a second consecutive time within a time interval equal or inferior to the threshold amount of time, then the second inner filament 126 will be fed with current instead of the first inner filament 124, thus emitting light of a second color outside of light bulb 110 due to the second coloring of second inner globe 122. It is thus possible to obtain three different colors from a same light bulb using a conventional socket and a conventional light switch.

Figure 6:
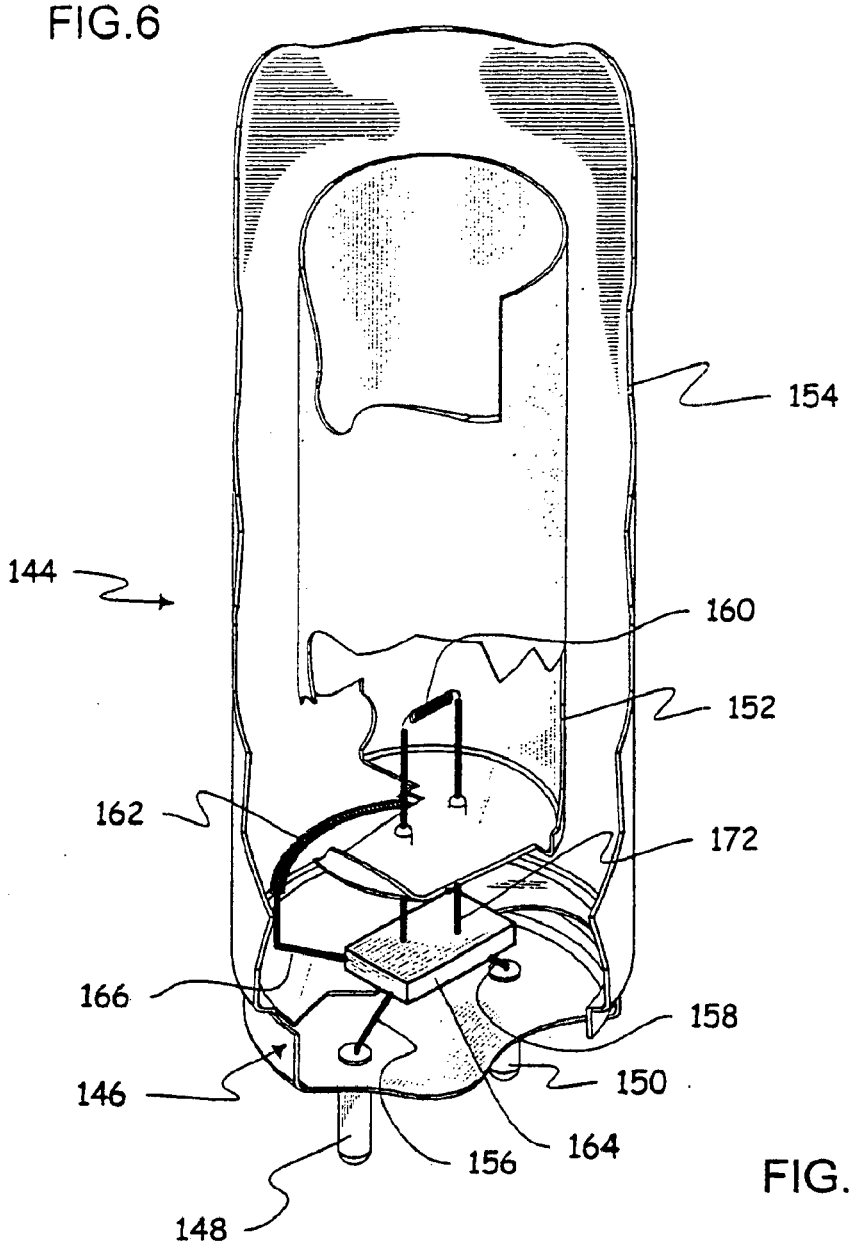
FIG. 6 is a partial perspective view, partly broken, of a neon tube lamp with two colors according to the present invention.
Figure 7:
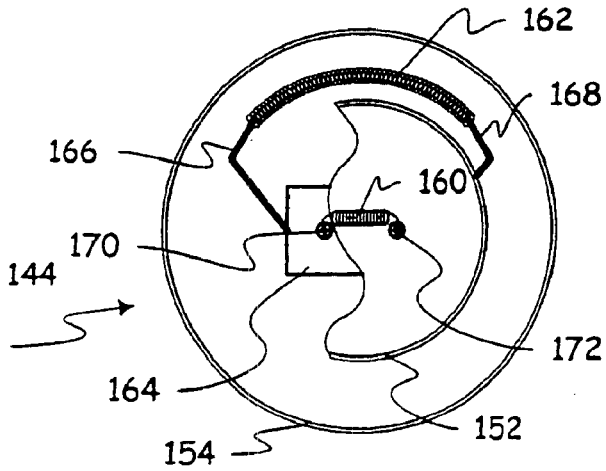
FIG. 7 is a cross-sectional view of the lamp of FIG. 6.

FIGS. 6 and 7 show a fourth embodiment of a two-color lamp 144 according to the present invention. The lamp 144 is a fluorescent neon-type lamp.

Lamp 144 includes a pin base 146 including a pair of connector pins 148, 150 for operative engagement with a conventional ballast socket (not shown). An inner and an outer sealed transparent or translucent tube 152, 154 are mounted between pin base 146 and the other pin base (not shown) opposite pin base 146. A pair of lead-in wires 156, 158 connect pins 148, 150 to control circuit 164. Control circuit 164 thus being connected to both an inner and an outer electrode 160, 162 located inside inner and outer tubes 152, 154 respectively, both inner and outer electrodes 160, 162 are connected to control circuit 164 through lead-in wires 166, 168, 170, 172 respectively. An inert gas such as neon is located inside the distinctly sealed-off areas inside each tube 152, and 154. A control circuit member 164 controls, in a similar manner than control circuit members 41 and 41", whether the inner electrode 160 or the outer electrode 162 will be activated depending on the light switch movement. The above-mentioned other pin base is identical to pin base 146.

As with the previous embodiment, if the circuit of lamp 144, from an initial closed condition in which the outer electrode 162 is activated, is opened and closed again within a time interval equal or inferior to a determined threshold amount of time, then the control circuit member 164 will activate the inner electrode 160 instead of the outer electrode 162. Otherwise, when the light switch closes the lamp circuit, outer electrode 162 is activated. Considering that tubes 152 and 154 may be of different colors, it is thus possible to select which color the tube 144 will be emitting by manipulating the conventional light switch, as with the previous embodiments of the invention.

Figure 9:
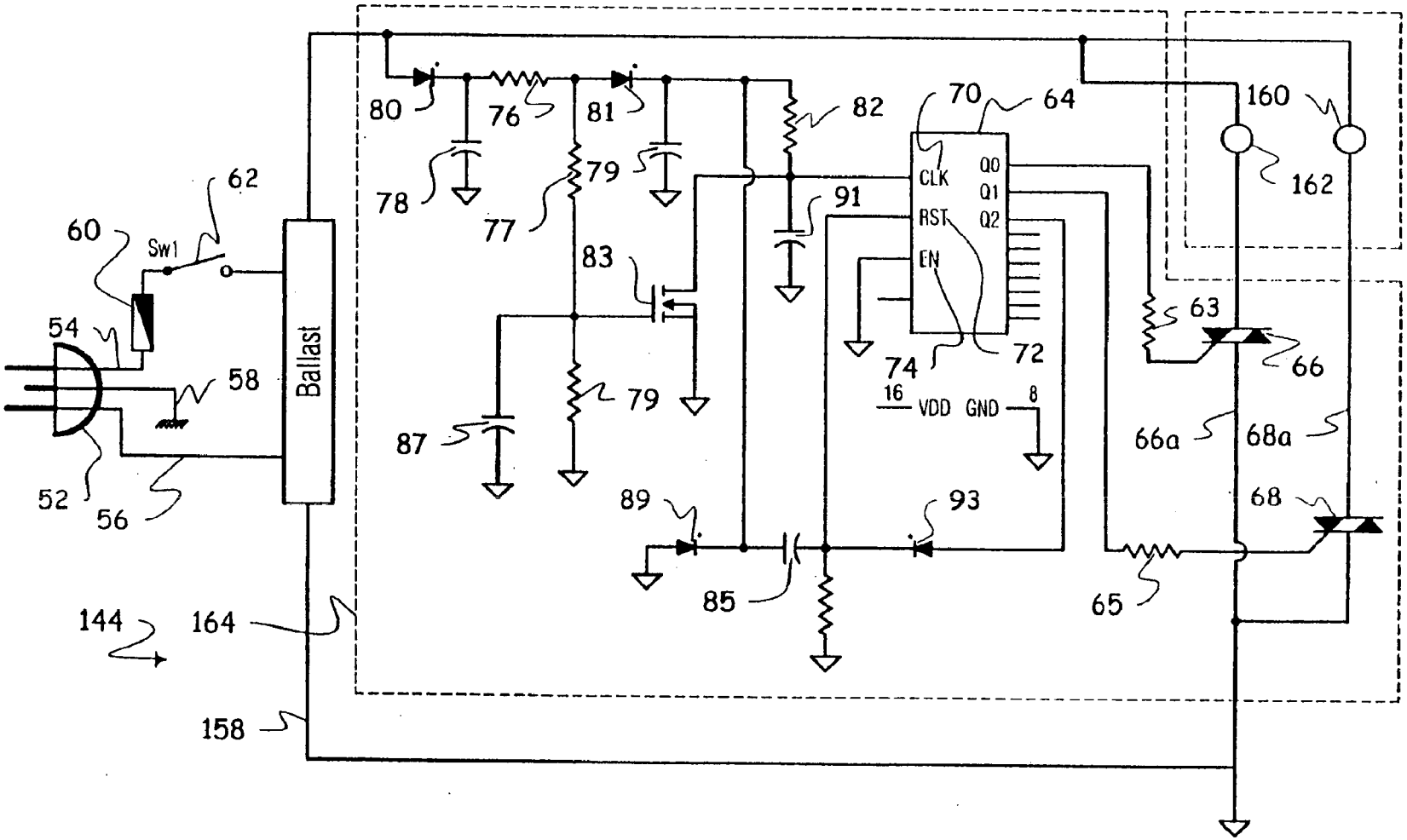
FIG. 9 is a diagram of the electrical circuit of the lamp of FIGS. 6 and 7.

FIG. 9 is a diagram of the circuit of lamp 144, including control circuit member 164. It can be seen that the diagram of FIG. 9 is similar in some respects to teh diagram of FIG. 2, except for the ballast required for the operation of the lamp 144.

It is understood that, in all of the embodiments of the present invention, the coloring of the globes can be selected as desired.

Also, it is envisioned to have lamps including more than two filaments or other light-producing elements, up to any number which may physically fit on the lamp.

Thus, a single lamp including a light bulb mounted on a conventional socket and activated with a conventional on/off light switch could consecutively produce an array of different colors by sequentially closing and opening the circuit of the lamp a number of times.

Furthermore, the first three disclosed embodiments are applied to incandescent lamps, while the fourth embodiment is applied to an inert-gas tube lamp type, but it is understood that any suitable type of lamp may be provided with the system according to the present invention, including for example a tungsten-halogen lamp or a portable flashlight with an incandescent filament. For ease of comprehension, we will define a light bulb as being the device which may be removably connected to a power supplied socket and which includes at least one light-producing element; this includes incandescent light bulbs, neon-type tubes, halogen-tungsten bulbs, and the like.

It is understood from the above-described embodiments and it will be obvious for someone skilled in the art of the invention, that different types of light-producing elements may be used. In the above first, second and third embodiments, each light-producing element was characterized by an incandescent filament located inside a globe formed by an at least partly surrounding transparent or translucent pane. In the fourth embodiment, the light producing element was a pair of electrodes located inside an inert gas filled sealed-off tube. But other types of light-producing elements could be used within the scope of the present invention. For example, all globes could be of a same color, while the filaments themselves could emit light of varying color or intensity. The "type" of light emitted by a light-producing element will be referred to as the light color and intensity. Also, the light-producing elements need not be located one within the other, but may be for example mounted side by side on the light bulb base.

All the embodiments have shown lamps in which at most a single one among all the light-producing elements is fed with electrical current at any given time. However, it is understood that more than one light-producing element could be fed with electrical current by simply associating specific TRIAC-type static switches with desired output values of the microchip. For example, a lamp comprising first and second filaments controlled by respective first and second TRIAC-type switches could have its output value Q0 of its microchip associated with the first TRIAC switch, its output value Q1 associated with the second TRIAC switch, while its output value Q2 could be associated with both the first and the second TRIAC switches. Upon the lamp main switch being closed a first time, the first TRIAC switch only would be activated by the microchip being initialized at output value Q0, and thus the first filament only would be fed with electrical current. If the switch is opened and closed a first time within a time interval equal or inferior to a determined threshold amount of time, then the microchip output Q1 would be activated instead of output Q0, and the second filament would be fed with electrical current. If the main switch is opened and closed a second consecutive time within a time interval equal or inferior to the threshold amount of time, then the microchip output Q2 would be activated instead of output Q1, and consequently both the first and second TRIAC switch would allow current to be fed to the first and second filaments, respectively.

I claim:

1. A lamp circuit including a power supply, a main switch, and a light and control circuit all serially connected, said light and control circuit comprising the following elements connected in parallel:

a) a first light-producing element capable of producing light of a first type and serially connected to a first switch member;

b) a second light-producing element capable of producing light of a second type and serially connected to a second switch member; and c) a control circuit member selectively commanding a selected one of said first switch member, said second switch member and both said first and second switch members to be closed upon said main switch closing said lamp circuit, said first and second switch members remaining opened if not commanded otherwise by said control circuit member.

2. A lamp circuit as defined in claim 1, wherein said control circuit member will selectively close a single one among said first and second switch members upon said main switch closing said lamp circuit, whereby said first light-producing element only will be fed with electrical current if said first switch member is closed, while said second light-producing element only will be fed with electrical current if said second switch member is closed, said lamp consequently emitting light of either one of said first and second types.

3. A lamp circuit according to claim 2, wherein said control circuit member includes a microchip capable of commanding a selected one of said first and second switch members to be closed upon said main switch closing said lamp circuit, and wherein said microchip will command said second switch member only to be closed thereby feeding said second light-producing member only with electrical current upon said main switch, from an initial closed condition, being opened and closed again within a time interval equal or inferior to a determined threshold amount of time, said microchip otherwise commanding said first switch member only to be closed thereby feeding said second light-producing member only with electrical current upon said main switch, from an initial opened condition, being closed.

4. A lamp circuit according to claim 3, wherein said threshold amount of time is controlled by means of a first capacitor provided in said control circuit member, which will feed said control circuit member, including said microchip, with a minimum working voltage value during a time interval equal to said threshold amount of time when said main switch opens said lamp circuit.

5. A lamp circuit according to claim 4, wherein said microchip includes a clock which will be fed with an electric pulse by a field effect transistor upon said main switch, from an initial closed condition, being opened and closed again within a time interval equal or inferior to said threshold amount of time, said second loaded capacitor remaining fed with electrical current during a time interval equal to said threshold amount of time by means of said first capacitor, said electric pulse activating said microchip clock for changing the output value of said microchip from a first output value associated with and commanding said first switch member to a second output value associated with and commanding said second switch member.

6. A lamp circuit according to claim 1, wherein said first and second switch members are both TRIAC-type static switches.

7. A lamp circuit according to claim 5, wherein said first and second switch members are both TRIAC-type static switches.

8. A lamp circuit according to claim 1, further including at least one additional light-producing element connected in parallel to said first light-producing element, said second light-producing element and said control circuit member, each said at least one additional light-producing element capable of producing light of a distinct type and serially connected to a corresponding switch member, said control circuit member selectively closing any single one among said first, second and at least one additional switch members upon said main switch closing said lamp circuit.

9. A lamp circuit according to claim 3, further including at least one additional light-producing element connected in parallel to said first light-producing element, said second light producing element and said control circuit member, each said additional light-producing element capable of producing light of a distinct type and serially connected to a corresponding additional switch member, said control circuit member selectively closing any single one among said first, second and additional switch members upon said main switch closing said lamp circuit, said microchip commanding said at least one additional switch member to be closed and all other switch members to be opened thereby feeding said corresponding additional light-producing member only with electrical current upon said main switch, from an initial closed condition in which a preceding switch member corresponding to a light-producing member was activated, being opened and closed again within a time interval equal or inferior to said threshold amount of time.

10. A lamp capable of emitting two different types of light, said lamp comprising:

a power supply;

a first light-producing element connected to said power supply and capable of producing light of a first type;

a second light-producing element connected to said power supply and capable of producing light of a second type;

a control circuit member connected to said power supply, to said first light-producing element and to said second light-producing element; and a main switch connected to said power supply, said control circuit member, said first light-producing element and said second light-producing element, said main switch allowing selective on/off feeding of electrical current from said power supply to a circuit assembly comprising said control circuit member, said first light-producing element and said second light-producing element;

wherein said control circuit member will selectively allow current to be fed to a selected one of said first light-producing element, said second light-producing element and the combination of said first light-producing element and said second light-producing element when said main switch allows current to be fed to said circuit assembly.

11. A lamp as defined in claim 10, wherein said first and second light-producing elements each comprises a pane enclosing an incandescent filament, with each said pane being a selected from transparent and translucent panes.

12. A lamp as defined in claim 11, wherein said pane of said first light-producing element is located within said pane of said second light-producing element, and said filament of said second light-producing element is located between said pane of said first light-producing element and said pane of said second light-producing element.

13. A lamp as defined in claim 12, wherein said pane of said first light-producing element is tainted of a selected color, and said pane of said second light-producing element is transparent.

14. A lamp as defined in claim 10, further comprising at least one additional light-producing element part of said circuit assembly and connected to said power supply, said control circuit member and said switch, said at least one additional light-producing element each capable of producing a light of an additional distinct type, wherein said control circuit member will selectively allow current to be fed to a selected one of said first light-producing element, said second light-producing element, said at least one additional light-producing element and a combination including a number of said light-producing elements when said switch allows current to be fed to said circuit assembly.

15. A lamp as defined in claim 10, wherein said first and second light-producing elements each comprises a tubular pane sealingly enclosing a pair of electrodes and an inert gas, with each said pane being selected from transparent and translucent panes.

16. A lamp as defined in claim 15, wherein said pane of said first light-producing element is located within said pane of said second light-producing element, and said pair of electrodes of said second light-producing element is located between said pane of said first light-producing element and said pane of said second light-producing element.

17. A lamp as defined in claim 16, wherein said pane of said first light-producing element is tainted of a selected color, and said pane of said second light-producing element is transparent.

18. A light bulb for use within a conventional lamp circuit of the type including a socket on which said light bulb may be electrically connected, a power supply connected to said socket, and a main switch allowing selective on/off feeding of electrical current to said socket, said light bulb comprising:

a base member shaped and sized for fitting said light bulb on said socket and for allowing operative electrical connection with said socket;

a first and at least one second light-producing elements operatively mounted to and electrically connected with said base;

a control circuit member mounted and electrically connected to said base and comprising a first and at least one second switch members each controlling a corresponding respective said first and at least one second light-producing elements;

wherein said control circuit member will command a selected single one among said second switch members to be closed and all other switch members to be opened thereby feeding only said second light-producing member corresponding to said selected one among said second switch members with electrical current upon said main switch, from an initial closed condition in which a preceding switch member corresponding to a light-producing member was activated, being opened and closed again within a time interval equal or inferior to a determined threshold amount of time, said control circuit member otherwise commanding said first switch member to be closed and all other said switch members to be opened thereby feeding only said first light-producing member corresponding to said first switch member with electrical current upon said main switch being closed.

* * * * *